United States Patent [19]

Folkerts

[11] 4,264,296

[45] Apr. 28, 1981

[54] CONTROL FOR FURNACE FLUE DAMPER

[76] Inventor: Walter E. Folkerts, 22680 Oak Ct., Hazel Park, Mich. 48030

[21] Appl. No.: 42,214

[22] Filed: May 24, 1979

[51] Int. Cl.[3] ..... F23N 3/02

[52] U.S. Cl. ..... 431/20; 126/235 R; 236/1 G; 137/98

[58] Field of Search ..... 236/1 G; 126/285 R; 431/20; 137/98

[56] References Cited

U.S. PATENT DOCUMENTS

| | | | |
|---|---|---|---|
| 1,813,395 | 7/1931 | Fraser | 236/1 G |
| 3,090,558 | 5/1963 | Vaughn | 236/1 G |
| 4,076,171 | 2/1978 | Swenson | 236/1 G |
| 4,182,483 | 1/1980 | Swenson | 236/1 G |
| 4,189,296 | 2/1980 | Hayes | 236/1 G X |

FOREIGN PATENT DOCUMENTS

| | | | |
|---|---|---|---|
| 855195 | 5/1939 | France | 236/1 G |

*Primary Examiner*—William E. Tapolcai, Jr.
*Attorney, Agent, or Firm*—Jay C. Taylor

[57] ABSTRACT

A pivotal vane carrying member secured to the damper for a furnace flue normally maintains the damper by gravity in an open position. An electric motor driven air blower discharges air against the vanes of the pivotal member to pivot the latter and damper to a closed position when no fuel is supplied to the furnace. Otherwise power for the blower motor is shut off and the pivotal member returns by gravity to its normal flue-open position.

8 Claims, 2 Drawing Figures

CONTROL FOR FURNACE FLUE DAMPER

BACKGROUND AND EXISTING PRIOR ART

This invention relates to improvements in a control means for closing the damper for a furnace flue when the associated furnace is not burning. Many automatic controls for such a damper have been proposed for the purpose of conserving fuel by closing the flue to prevent heat loss therethrough when the furnace is not operating. A characteristic common to many such controls is a mechanical or electrical linkage between the actuating means of the control and the actuated means connected with the damper.

Other types of controls operate to open a normally closed damper when the furnace is burning. In either type of control, a failure in the damper operating linkage could leave the flue closed when the furnace is burning, with the result that dangerous furnace combustion products could escape into a living area. A similar objectional consequence could occur with many such controls in the event of power failure for the damper control.

The following patents are typical of the prior art: Scott U.S. Pat. No. 1,743,731 shows a furnace blower that causes a normally closed damper (in contrast to applicant's normally open damper) to open when the furnace is burning. Goodridge U.S. Pat. No. 1,863,443 discusses the possibility of using a positive displacement blower to close the flue when the furnace is not operating. Otherwise no automatic damper control is shown. Wetzsteon U.S. Pat. No. 2,296,410 is concerned with control means for effecting a substantially constant flue draft pressure. No means are shown for closing the damper when the furnace is not burning. The above noted patents, as well as Olsen U.S. Pat. No. 2,303,135 and Holtzman et al U.S. Pat. No. 3,273,625 show various elements per se suitable for use in applicant's construction, but in entirely unrelated applications.

IMPORTANT OBJECTS OF THE INVENTION

A primary object of the present invention is to provide a comparatively fail-safe automatic flue damper control means which is exceptionally efficient, simple in concept and operation, and capable of being easily and economically manufactured and installed.

Another object is to provide such a control means that normally holds the damper in its flue-open position and is responsive to the inverse of a suitable condition required for operation of the furnace in a combustion mode to move the damper to its flue-closing or restricting position when the furnace is not operating in its combustion mode.

Other more specific objects are to provide damper control means having an actuated or damper moving member connected with the damper and normally held by gravity force in a flue-open position, wherein the damper moving member is responsive to a predetermined fluid pressure for moving the damper to its flue-closing or restricting position; wherein means inversely responsive to fuel flow to the furnace, or to a low ambient temperature condition calling for heat, enable the damper moving member to move from its normal flue-open position to a flue-closed or restricted position when no fuel is supplied to the furnace, or when the ambient temperature is too high to call for furnace heat; wherein power driven pressure actuating means responsive to cessation of the aforesaid condition required for furnace combustion applies the predetermined pressure to move the damper moving member and connected damper to their respective flue restricting positions; and wherein no mechanical or physical connection exists between the actuated damper moving member and the pressure actuating means, so that the damper moving member and damper are fail-safe and remain at their normally open positions in the event of a power failure.

Other objects are to provide a damper control means wherein power to the pressure actuating means is controlled by a normally open switch that may be operated conjointly with the furnace fuel control valve to remain open when the fuel valve opens to supply furnace fuel, to close when the fuel valve closes to shut-off fuel to the furnace, and to prevent opening of the fuel valve when the switch is closed; wherein the switch may be responsive to fuel pressure to close when fuel to the furnace is shut-off completly and to enable gravity return of the damper to its open position when fuel is supplied to the furnace, thereby to enable the escape of fuel gas via the flue in the event of fuel leakage past a defective fuel valve when the furnace is not burning; and wherein the switch may be operated by a fail-safe solenoid in the electric circuitry for the furnace, such that when the solenoid fails or the switch otherwise fails to open, the circuit for operating the furnace fuel valve will also be broken and the fuel valve will not open.

Other objects are to provide such a control means comprising a light spring cooperable with the damper moving member to give the latter in initial boost in the flue opening direction from the closed position, thereby to assist the gravity induced opening force to overcome starting friction when the fluid pressure is not applied to hold the damper closed; and to provide a small fractional horsepower electric motor for driving an air blower, and duct means for conducting the air flow from the blower to vanes on the damper moving member to move the latter and damper to their flue restricting positions.

Other objects are to arrange the damper moving member and blower in proximity to the flue so that the air directed against the vanes also tends to maintain air circulation in the vicinity of the flue and assist in dissipating heat from the flue to the adjacent living area, rather than to allow the escape of such heat via the chimney; and to provide an abutment seal within the flue for abutting peripheral portions of the usual butterfly type damper in the flue-closed position, thereby to enable adequate clearance and to avoid frictional interference between the damper and flue.

Other objects of this invention will appear in the following description and appended claims, reference being had to the accompanying drawings forming a part of this specification wherein like reference characters designate corresponding parts in the several views.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
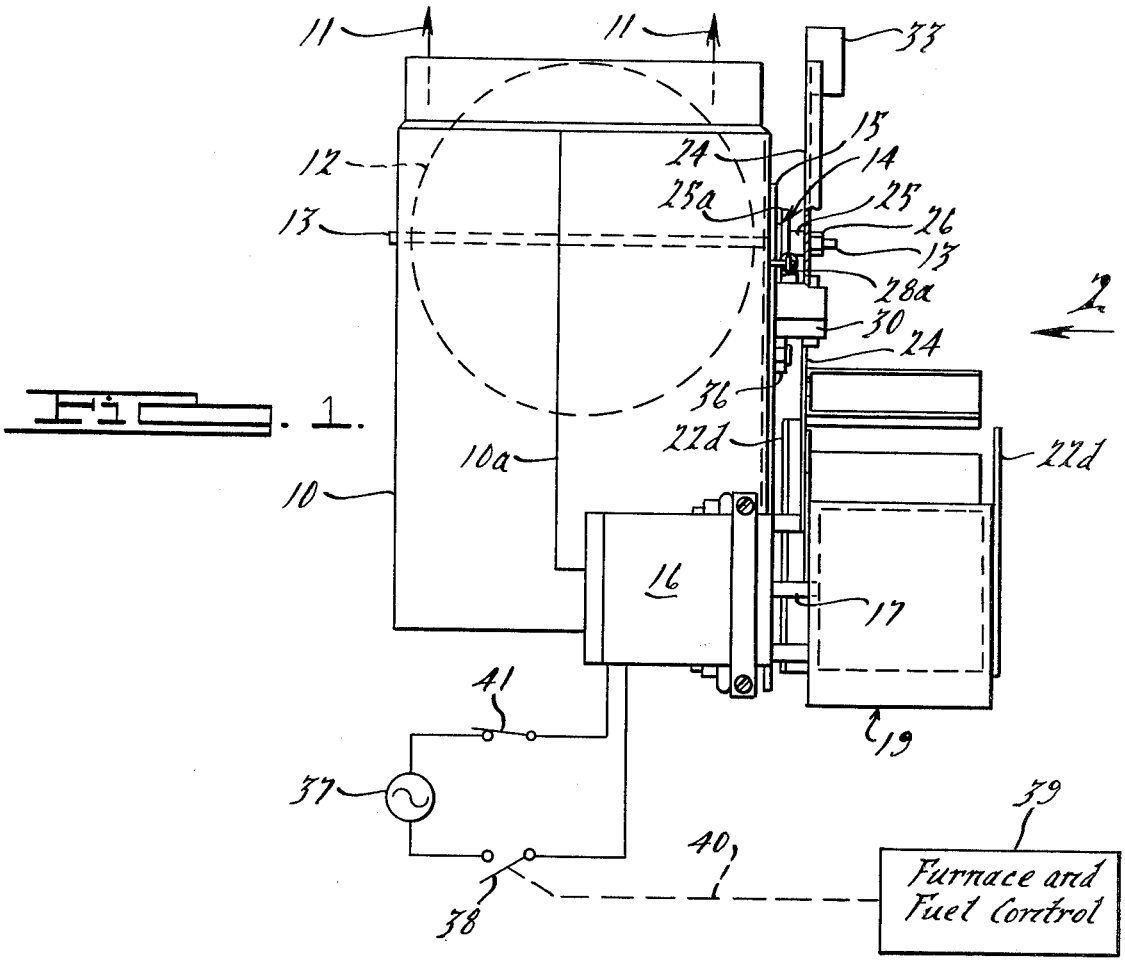
FIG. 1 is a schematic elevational view of a preferred damper control system embodying the present invention.

Referring to the drawings, a circular cross-section portion of a typical flue 10 for the gaseous combustion products flowing in the direction of the arrows 11, from a furnace to the atmosphere, contains a conventional sheet steel butterfly type damper 12 pivotal about the axis of an integral diametrical stainless steel shaft 13 of small diameter. The latter extends horizontally in opposite directions freely pivotally through the sidewalls of the flue 10 and may be journaled at its right end, FIG. 1, in a pilot bearing 14 carried by a motor and blower support 15 which is adjustably secured exteriorly to the flue 10 as described below.

Suitably secured to one side of the lower end of support 15 is a small electric motor 16 having an axial rotor shaft 17 suitably secured coaxially to the squirrel cage type impeller 18 of a centrifugal air blower 19 which is also secured to the support 15. The impeller 18 is rotatable in the blower 19 and is provided with a plurality of peripheral circumferentially spaced impeller blades 20 which, upon counterclockwise rotation of the impeller 18, discharge a stream of air in the direction of the arrows 21 along a guide chute or trough 22. The latter has an air inlet **22*a* secured to the air discharge portion 19*a* of blower 19 and comprises a bottom 22*b*, an open air discharge end 22*c*, parallel spaced sides 22*d*, and opens upwardly to receive freely spaced between the sides 22*d* plurality of pressure actuated vanes 23 of a pivotal pressure and gravity actuated damper moving member 24**.

The member 24 is also freely spaced from bushing 14 by an integral flanged pilot bushing 25 adjustably splined on shaft 13 in the position shown for pivoting as a unit with shaft 13 and damper 12 and is secured against endwise movement from shaft 13 by a nut and non-loosening retainer assembly 26.

The bushing 25 has an annular flange **25*a* provided with a spring retaining hole 27 connected with one end of a lightweight stainless steel helical spring 28. The other end of spring 28 extends endwise of the helix 28 through a small opening in a detent 29 and terminates in an enlargement 28*a* oversize with respect to the aforesaid detent opening. The detent 29 comprises an extension of a fixed stop 30 secured to the arm 15 and is adapted to engage an edge of member 24 to limit its clockwise pivoting at the damper-open position, FIG. 2 whereas the enlargement 28*a* is spaced leftward of the detent 29 to enable limited rightward lost motion of the spring 28 with respect to the detent 29**.

Figure 2:
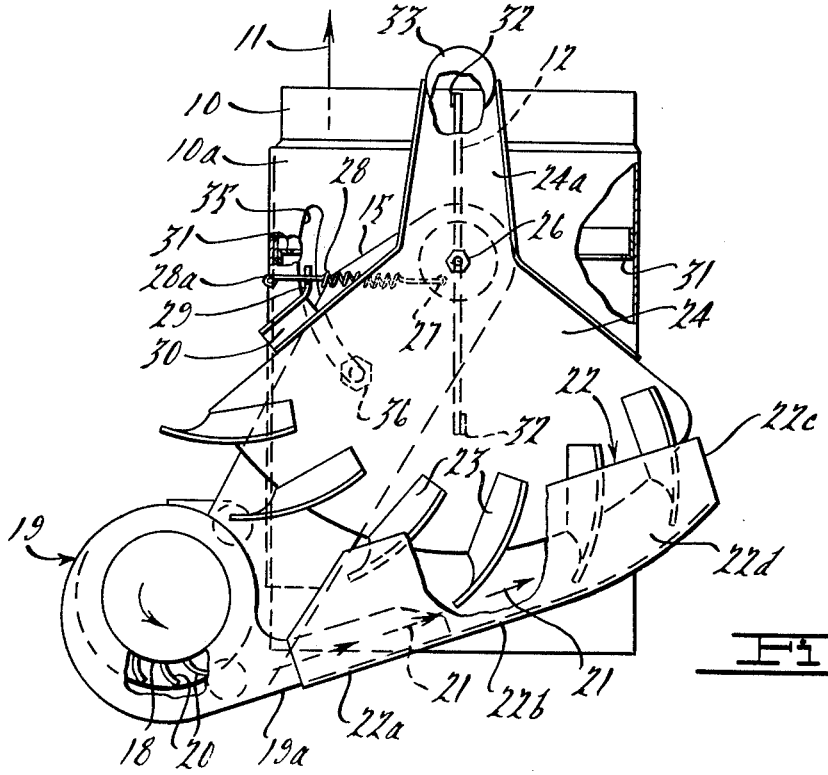
FIG. 2 is an elevational view with portions broken away, looking in the direction of the arrow 2 of FIG. 1.

After a limited counterclockwise pivoting of member 24 from the open position shown in FIG. 2, the enlargement **28*a* engages the detent 29. Thereafter continued counterclockwise pivoting of member 24 toward the damper-closed position progressively tenses spring 28 to urge return or opening movement of the member 24 and connected damper 12. The primary purpose of spring 28 is to overcome any initiai starting friction and inertia of the member 24 when the latter and damper 12 return to their normally open positions as described below. The spring 28** is merely an added safety feature and is not essential to operation of the damper control, especially since all the pivotal actions involved are essentially frictionless compared to the positive operating forces.

The stop 30 preferably comprises a cushioning material to absorb the impact of the member 24 when it pivots to its normally open position. Internally of the flue 10 is an essentially semi-annular damper stop and seal 31 arranged to engage a mating essentially semi annular pad 32 on the adjacent upper surface of the right side of damper 12 when the latter is closed. The pad 32 may simply comprise an offset peripheral portion of the damper 12. A similar seal and damper stop combination 31, 32 is provided for the underside of the left side of damper 12 at the closed position. Accordingly the damper 12 and flue 10 need not be accurately fitted or matched to enable closing of the latter by the damper 12. More importantly, frictional interference between the flue 10 and pivotal damper 12 is positively avoided.

The member 24 and vanes 23 secured thereto may be lightweight sheet plastic or metal, such as aluminum which may be crimped or flanged for reinforcement, as for example along its edges. The weight of the vanes 23 and enlarged portion of the member 24 below its pivot axis is more than adequate to return the damper 12 to its flue-open position when not otherwise urged to its closed position by air pressure as described below. Accordingly, a light counterbalancing weight 33 may be provided on an arm 34 of the member 24 that extends upright from the pivot axis at the flue-open position.

The bushing 25 and shaft 13 may be provided with mating axially extending spline serrations to enable initial adjustment of the member 24 when it is splined to shaft 13 for pivoting therewith. Thus the damper 12 will always be fully open when the member 24, integral with bushing 25, is at the position of FIG. 2. However the flue 10 may extend horizontally or may be inclined in various installations. Accordingly, the angular position of the motor and blower support 15 with respect to the flue 10 must be adjusted in order to maintain the relationship between the blower 19 and vanes 23 shown in FIG. 2. To this end the exterior bracket **10*a* fixed with respect to the flue 10 is provided with a circular slot 35 centered at the pivot axis of shaft 13. The support 15 carries bushing 14 and is thus supported by shaft 13 and is pivotally adjustable about the axis of the latter until the chute 22 is positioned with respect to the vanes 23 as illustrated in FIG. 2. Thereafter clamping means such as a bolt and nut assembly 36 carried by support 15 and located within slot 35 is tightened to clamp the support 15 and bracket 10*a*** securely together.

The motor 16 may be on the order of a hundredth of a horsepower or smaller because only nominal power is required to operate blower 19 and discharge a stream of air 21 via chute 22 with sufficient force against the vanes 23 to blow the member 24 and connected damper to the closed position. The motor 16 is powered by an operative electrical circuit 37 which includes a normally open switch 38 operatively connected with the furnace system associated with flue 10 to close upon the occurrence of a predetermined operating condition normally associated with the furnace in its non-combustion "off" mode of operation, as for example a predetermined high temperature condition at the thermostat control for the furnace, or the closing of the furnace fuel supply valve in the fuel system 39 which is operatively connected with switch 38 as indicated by the broken line 40. A second manually operated normally closed switch 41 may be provided in series with the switch 38 to prevent operation of motor 16 regardless of the furnace operating mode, as for example when repairs are being made or whenever closing of the damper 12 is not desired.

Operation of the device described above is believed to be apparent from the foregoing. When no fuel is flowing via the system 39 to the furnace, normally open switch 38 closes and motor 16 is energized, assuming that normally closed switch 41 is also closed, and an air stream discharged from blower 16 is directed by chute 22 against the blades 23, thereby to apply the necessary predetermined pressure differential at the latter to pivot member 24 and damper 10 counterclockwise to their closed positions whereat the stops 31 engage the peripheral portions 32 of the damper 12 and prevent further counterclockwise movement. In the event of fuel gas flow via the system 39 to the furnace, whether by leakage through a faulty valve or because of combustion in the furnace, switch 38 opens, motor 16 and blower 19 stop, and the weight of the enlarged vane carrying portion of member 24 pivots the latter and damper 12 clockwise to their flue open positions. Such action is initially assisted by the spring 28 which was tensioned by the prior counterclockwise closing movement of member 24 as described above.

Having thus described my invention, I claim:

1. A combination in means for controling a flue damper for a furnace operative intermittently in a combustion mode and a non-combustion "off" mode and for moving the damper to a flue restricting position when the furnace is in its "off" mode comprising damper operating means for normally urging the damper to a flue-open position, the damper operating means including pivotal vane means responsive to a predetermined air flow for pivoting to a predetermined position and having means for urging the damper to said flue-restricting position upon pivoting of said pivotal means to said predetermined position, air blowing means energizable for effecting said predetermined air flow, and means responsive to an operating condition of the furnace associated with the "off" mode for energizing the air blowing means.

2. A combination according to claim 1, the damper operating means comprising gravity actuated means for urging the damper to its normally open position.

3. A combination according to claim 1, the vane means comprising a pivotal member pivotal between open and restricting positions and having vanes thereon responsive to said predetermined air flow for pivoting the member to its restricting position, means for normally pivoting the member to the open position, and means for moving the damper to its flue open and flue restricting positions in unison with pivoting of the member to its open and restricting positions respectively.

4. A combination according to claim 3, the means for pivoting the member to its open position comprising gravity actuated means.

5. A combination according to claim 4, the pivot axis for the pivotal member having a horizontal component, the vanes being arranged on the pivotal member to urge the latter by gravity to its open position, and the air blowing means being arranged for directing said predetermined air flow against the vanes.

6. A combination according to claim 1, resilient means tensed in opposition to the force of said air flow for effecting an initial opening movement of the member upon termination of the air flow.

7. A combination according to claim 1, means for effecting a seal between the interior wall of the flue and peripheral portions of a butterfly type damper pivotally mounted within the flue comprising flange means arranged on the interior wall to abut the peripheral portions in overlapping relationship when the damper is at its flue restriction position.

8. A combination according to claim 1, and comprising in addition a section of furnace flue, a flue damper pivotal in the flue section, means adjustably keying the damper and damper operating means together for pivoting as a unit between the flue open and flue restricting positions, and said means responsive to said operating condition comprising means responsive to the furnace fuel system for energizing said air blowing means when no fuel is flowing through said system.

* * * * *